US007578428B2

(12) United States Patent
Charlton

(10) Patent No.: US 7,578,428 B2
(45) Date of Patent: Aug. 25, 2009

(54) CARRY-OUT FOOD CONTAINER WITH STRUCTURAL INSERT

(75) Inventor: Todd R. Charlton, Minnetonka, MN (US)

(73) Assignee: PDOC, LLC, Chicago, IL (US)

( * ) Notice: Subject to any disclaimer, the term of this patent is extended or adjusted under 35 U.S.C. 154(b) by 234 days.

(21) Appl. No.: 11/054,698

(22) Filed: Feb. 10, 2005

(65) Prior Publication Data

US 2005/0274780 A1 Dec. 15, 2005

Related U.S. Application Data

(60) Provisional application No. 60/579,753, filed on Jun. 14, 2004.

(51) Int. Cl.
*B65D 5/00* (2006.01)
*B65D 5/62* (2006.01)
*B65D 33/02* (2006.01)

(52) U.S. Cl. ..... 229/164.1; 229/110; 229/906; 383/119

(58) Field of Classification Search ..... 229/164.1, 229/162.3, 162.1, 87.18, 116.5, 164.2, 5.81, 229/203, 923, 902, 906, 110; 383/119, 106
See application file for complete search history.

(56) References Cited

U.S. PATENT DOCUMENTS 2,555,584 A * 6/1951 Fairbank ..... 426/396
3,048,319 A * 8/1962 Lowe ..... 229/162.1
3,650,383 A * 3/1972 Nigro ..... 229/112
4,301,960 A * 11/1981 Alexander et al. ..... 229/164.1
4,341,825 A * 7/1982 Kemski ..... 206/484
4,494,689 A * 1/1985 Ilitch ..... 206/525
4,635,843 A * 1/1987 Tomlinson ..... 229/117.18
5,239,741 A * 8/1993 Shamos ..... 29/521
5,364,015 A * 11/1994 Hirschey ..... 229/116.5
5,423,477 A * 6/1995 Valdman et al. ..... 229/104
5,535,940 A * 7/1996 Olds ..... 229/110
5,863,576 A * 1/1999 Guarino ..... 426/107
6,033,114 A * 3/2000 Grimm et al. ..... 383/106

* cited by examiner

*Primary Examiner*—Gary E Elkins
*Assistant Examiner*—Christopher Demeree
(74) *Attorney, Agent, or Firm*—Fitch, Even, Tabin & Flannery

(57) ABSTRACT

A carry-out food container comprised of a flexible open-ended, bag-like container having an upper partially transparent panel and a lower panel, in combination with a food tray which is movable into and out of the closable open end of the bag-like container, the tray having a food-supporting planar base panel with a peripheral edge supporting an upstanding sidewall that extends partially therearound to define an unrestricted access to the interior of the tray, the tray being freely movable within the container to a position where the tray base panel is beneath the window and its unrestricted access is adjacent to and slightly inward of the openable end of the closable container.

2 Claims, 4 Drawing Sheets

CARRY-OUT FOOD CONTAINER WITH STRUCTURAL INSERT

This application is an application for a patent which is also disclosed in Provisional Application Ser. No. 60/579,753, filed on Jun. 14, 2004 by the same inventor, namely Todd R. Charlton, and entitled "CARRY-OUT FOOD CONTAINER WITH STRUCTURAL INSERT," the benefit of the filing date of which is hereby claimed.

BACKGROUND OF THE INVENTION

A need exists, especially in the prepared food market, for improved packaging. For example, a great number of foods, such as prepared pizza, is sold in carry-out packages which preclude the prospective purchaser from having accurate and reliable information as to the condition and content of the food which is being offered for purchase. This is true because the package is frequently designed so that the food product cannot be adequately viewed or is not viewable to any extent at all. Many times the container is weak and can be readily deformed, so that stacking of the containers, as is frequently required, results in crushed containers and damaged or spoiled food product.

In addition, many food product items, such as pizza, are difficult to load, remove, or otherwise handle utilizing conventional packaging, and are not readily accessible to the purchaser because of inadequate container design. As a consequence, the person packaging the food product, and prospective purchaser thereof, are often required to manually touch the food product in order to inspect or handle same, which is extremely unsanitary. There is no provision for the host or packager to readily scoop or otherwise handle or access the food product without manually touching same.

It is also imperative that the temperature of many food items, such as pizza, be maintained during storage or transportation to a desired destination. If the food container is of inadequate strength and design, as in many conventional designs, the rate of package respiration can significantly affect heat loss, product shelf life, and the desirability of the end product being sold. Therefore, there is a distinct need for a food container which retains the heat within the food and, at the same time, enables the purchaser to view the contents of the package. The invention disclosed herein meets all of these requirements.

BRIEF SUMMARY OF THE INVENTION

The current needs outlined hereinabove are met by the invention to be described herein. As described hereinafter, my invention, comprising a unique carry-out food container, is composed generally of an outer bag-like container in combination with a uniquely designed food tray insert made of corrugated paperboard. The outer container is comprised principally of a pair of spaced opposing panels that are made primarily of a thin, light-weight, flexible material. These panels are connected together at one end and at opposite sides, and open but closable at the other end, with one of the panels having a window that is transparent and substantially fog-resistant.

The tray insert is preferably monolithically designed of a one-piece construction with a relatively rigid, grease and moisture-resistant base panel having a peripheral edge of generally U-shape configuration which supports a rigid upstanding sidewall therealong. Optionally, the base panel may be embossed or debossed in such manner as to provide air pockets and/or air circulation between the food product and top surface of the panel, thereby further reducing the potential for moisture related problems generally associated with heated articles of food.

The tray sidewall is continuous along the peripheral edge of the tray except at its rear edge, where at least a portion thereof remains open for accessibility. The upstanding sidewall is of substantial height so as to insure that the food which is received and supported by the base panel of the tray will not touch the window of the container. The height of the upstanding tray sidewall is slightly less that the height of the sidewalls of the container, but sufficient to extend above the food item being carried and maintain adequate spacing between the food and the container window.

In the preferred embodiment, the entire rear end of the sidewall which extends upwardly from the peripheral edge of the base panel of the tray is left open to provide easy access to the interior of the tray and its food contents. This side access to the tray also facilitates safe and sanitary handling of food items, as it can function as a scoop allowing the person packaging the container to handle its contents without touching same.

In a second embodiment of the invention, the upstanding sidewall of the tray extends around the entire peripheral edge of the base panel, but ready access to the interior of the tray is provided by an arcuately shaped cut-out at the upper edge of the rear wall, at a point adjacent the middle of that wall. Other than the difference between the access at the rear of the two trays, the two embodiments may be constructed highly similar.

With my improved carry-out food container, prepared food items may be stored and maintained in a fresh heated condition whilst allowing the prospective purchaser to view the contents and condition of the food item being purchased. The insertable tray is constructed of suitable strength and structural integrity to facilitate easy stacking of the containers, and to prevent the outer container from collapsing and sticking to the food item contained therein. Also, with the uniquely constructed side access to the tray, accessibility to the food contents being carried is improved, and cleanliness in food handling is significantly enhanced.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
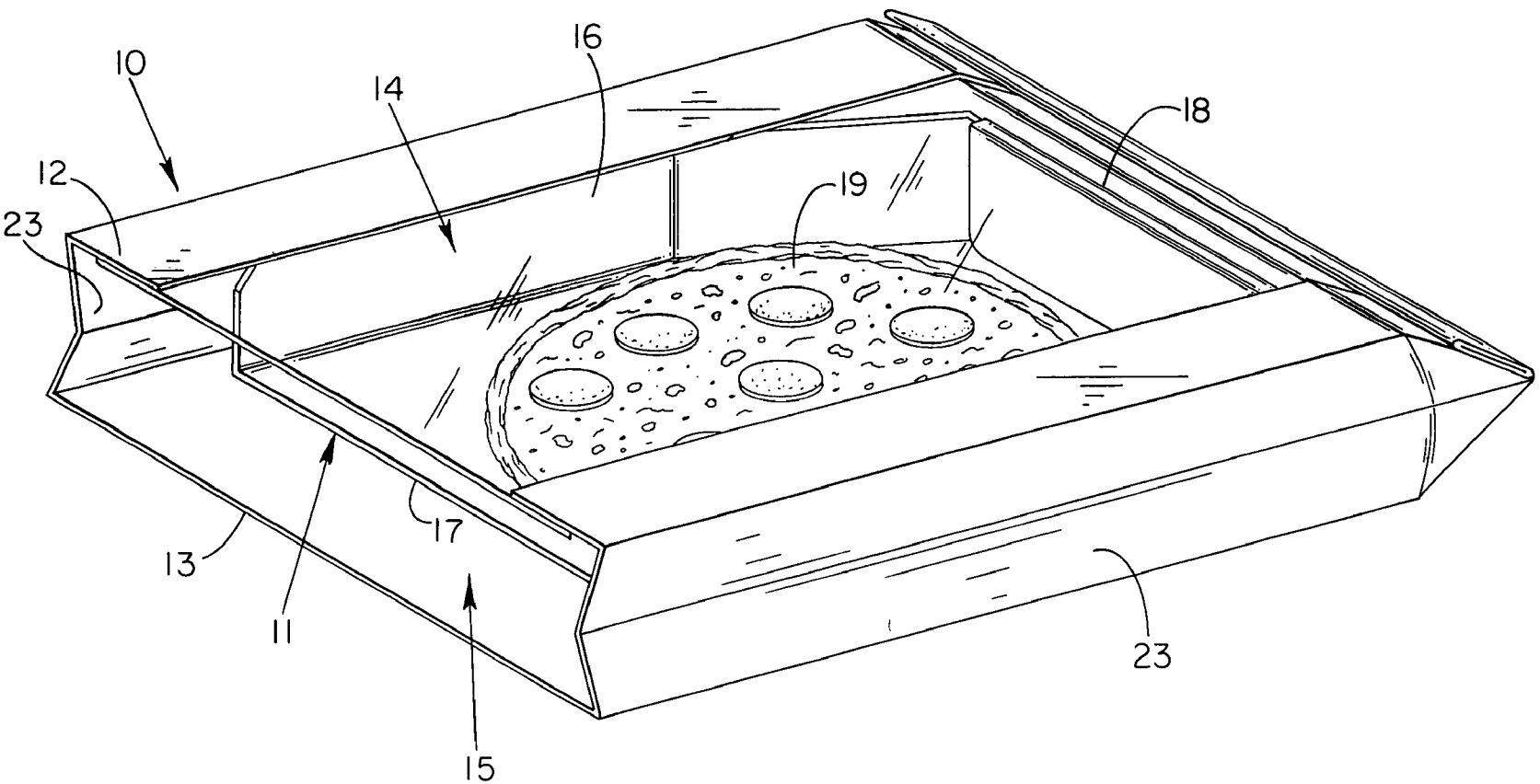
FIG. 1 is a perspective view of the preferred embodiment of the invention, with the food-bearing tray shown within the outer bag-like container in its assembled position.
Figure 2:
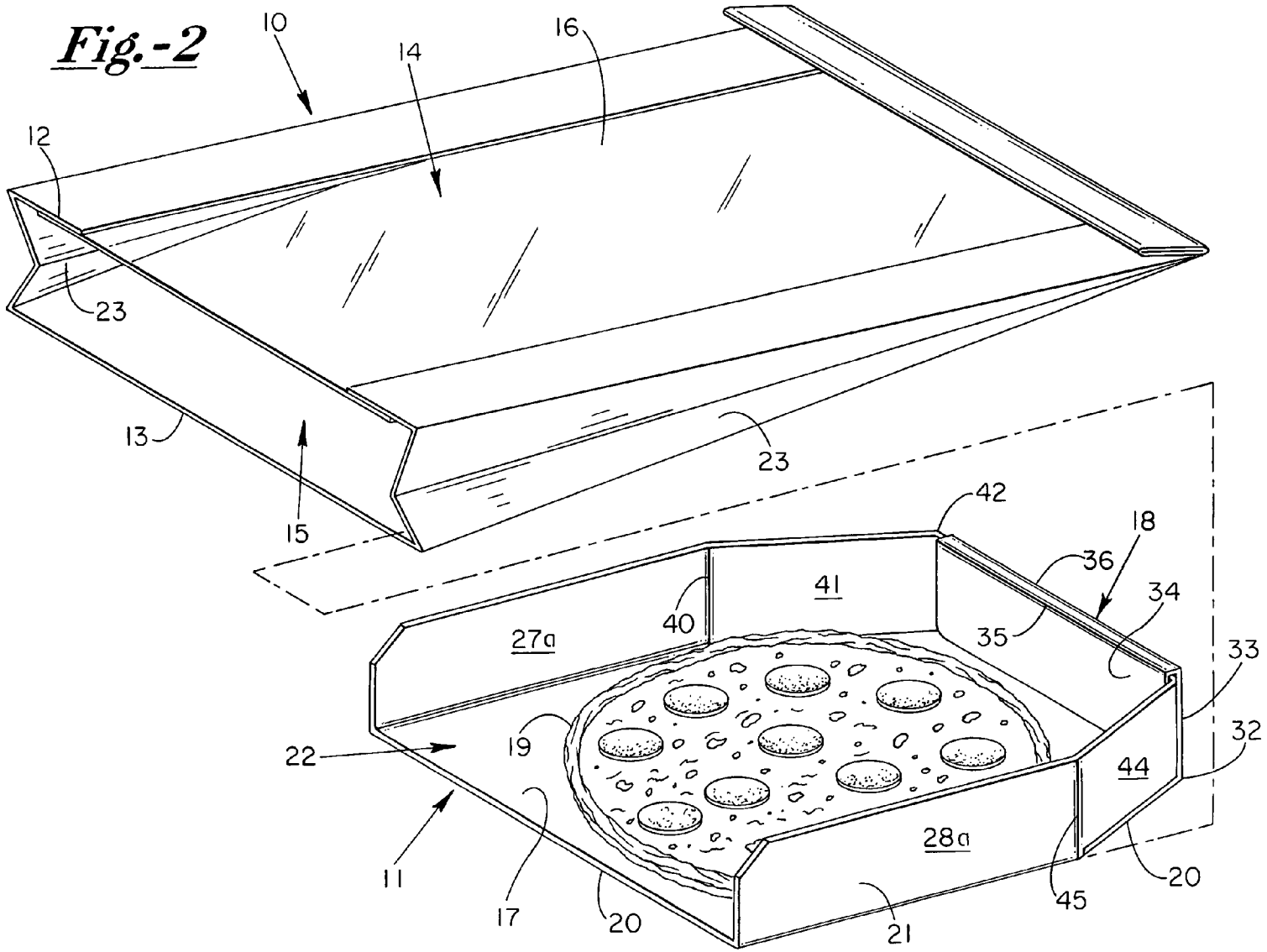
FIG. 2 is an exploded view of the combination shown in FIG. 1, with the tray oriented in position preparatory to being inserted into the open end of the bag-like container.

With reference being made to FIGS. 1 and 2, it is seen that the carry-out food container is comprised of a light-weight, bag-like container 10, and a food tray 11 in combination therewith and adapted to be inserted therein. The container 10 is constructed of a relatively thin, light-weight flexible material and has opposed upper 12 and lower 13 generally planar panels connected together at their sides and at one end to form an interior cavity 14, with a closable opening 15 at the other end thereof. At least a portion 16 of the upper panel 12 is preferably transparent and substantially fog-resistant to facilitate viewing of the food carried on tray 11, when it is positioned within container 10 upon the lower panel 13. As shown, the tray 11 has a generally planar base panel 17 with a peripheral edge 20 extending therearound. The food tray 11 is preferably constructed of a paperboard material which has sufficient structural integrity to support an article of food 19 thereon, and to prevent premature collapsing thereof. This material from which the food tray 11 is made is well-known in the art as being of corrugated paperboard construction, and is preferably grease and moisture-resistant to protect the food which it will support, and to preclude penetration of the planar base panel 17 by its moisture.

Figure 3:
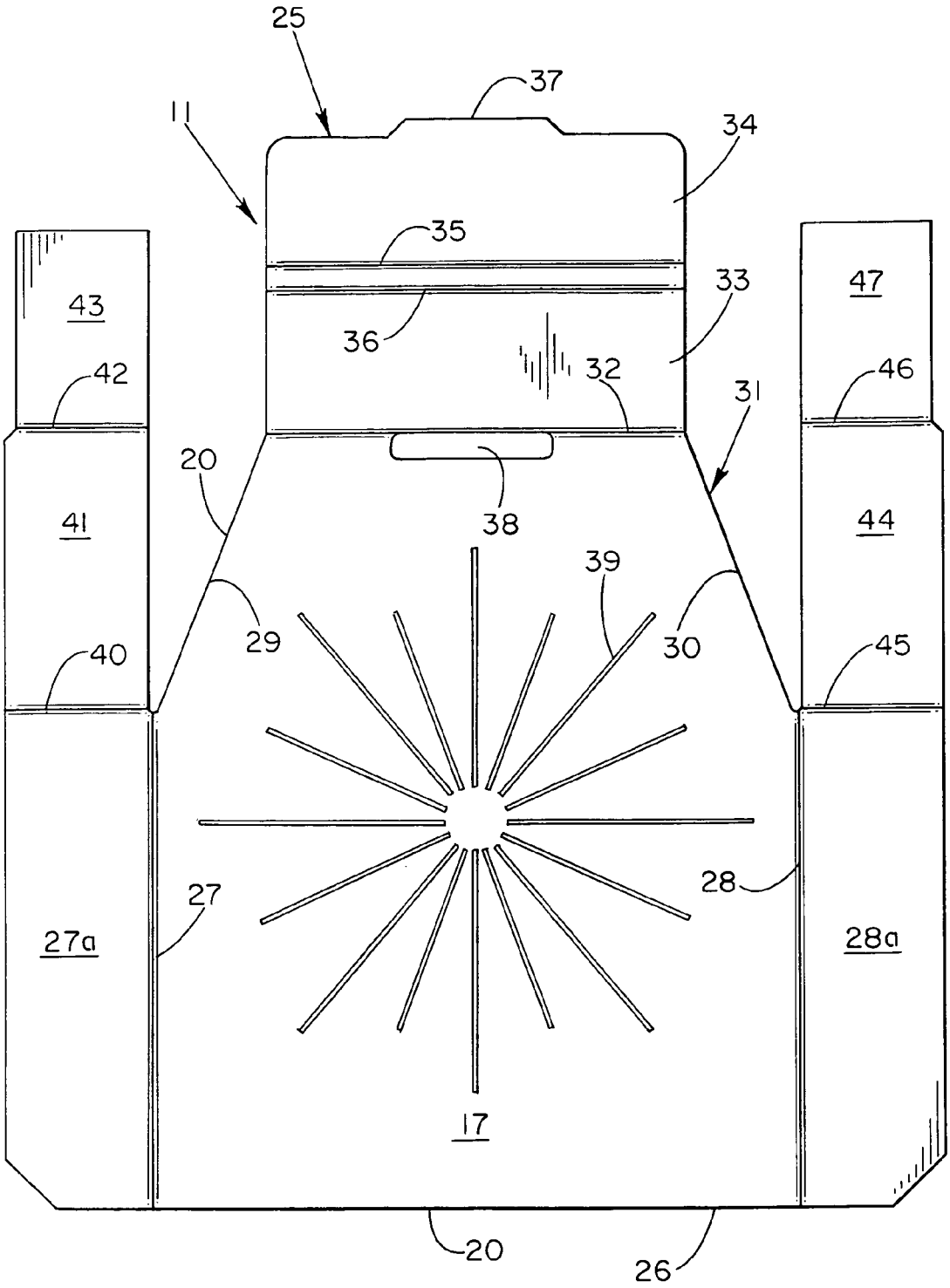
FIG. 3 is a plan view of the blank from which the food tray shown in FIGS. 1 and 2 can be assembled as described herein.

Optionally, the base panel 17 may be embossed or debossed in such manner as to provide air pockets and/or air circulation between the food product and top surface of the panel 17, thereby further reducing the potential for moisture related problems generally associated with heated articles of food. In one such embodiment, as shown in FIG. 3, it is contemplated that the upper surface of the panel 17 be embossed in a specialized pattern, such as with radially extending ribs 39, so as to enhance the tray's ability to evacuate excess steam and moisture, thereby prolonging the food product's shelf-life and retaining the product's oven-fresh crispness. Preferably, ribs 39 are constructed to protrude outwardly from panel 17 approximately 0.062 inches, or more.

In the preferred embodiment of my invention, the peripheral edge 20 of the base panel 17 supports a vertically upstanding sidewall 21, which partially surrounds the base panel 17 to define the side access 22 at its rearward end. Preferably, sidewall 21 extends upwardly from base panel 17 a distance of approximately 1 to 1.5 inches. The height of the sidewall 21 is slightly less than the height of the sides 23 of the container 10 in order to facilitate easy entrance into, and removal of the tray 11 from the interior cavity 14 of the bag-like container 10. However, sidewall 21 is of sufficient height so as to support the upper panel 12 above the food item 19 when a food-laden tray 11 is positioned within the container 10.

The sidewall 21 tapers inwardly at the forward end 18 of tray 11 which is opposite the side access 22, and consequently the width of the side access 22 of the tray 11 along the peripheral edge 20 is substantially greater than the opposite forward end 18 of the tray. Thus, as shown in the drawings, the portion of the peripheral edge 20 which supports the sidewall 21 of the tray 11 is generally U-shaped in configuration. This helps to further facilitate loading and positioning of the tray 11 within the confines of outer container 10.

The dimensions of tray 11 are such that the tray is freely movable within the bag-like container 10 to facilitate insertion and removal thereof from and into said interior cavity 14 through the opening 15. The base 17 of the tray 11 is constructed to rest during storage on the lower panel 13 of the container 10, within the cavity 14. Its dimensions are determined and provided such that the side access 22 of the tray 11 is adjacent to and faces the opening 15 of the flexible container 10 when the tray 11 is properly inserted into storing position therein.

As shown best in FIG. 3, the preferred embodiment of tray 11 is preferably made from a monolithic corrugated cardboard blank 25. The corrugated cardboard from which the blank 25 is made provides ample rigidity for the tray 11 and its upstanding sidewall 21. As shown in FIG. 3, the blank 25 is generally rectangular in shape, particularly with respect to its rear end portion 26, which forms the side access 22 of tray 11. Extending longitudinally forward from rear end portion 26 of blank 25 are a pair of crease lines 27 and 28, one at each side of the blank. These crease lines 27 and 28 facilitate formation of the upstanding sidewall portions 27*a* and 28*a* of sidewall 21 by bending such portions upwardly along said lines. The peripheral edge 20 of the base panel 17 extends along said crease lines 27 and 28.

At the forward end of the crease line 27, there is a narrowing of the base panel 17 along line 29. At the forward end of the crease line 28, there is a corresponding narrowing of the base panel 17, along line 30. The two lines 29 and 30, and peripheral edge portions formed thereby, terminate opposite each other at bend line 32, as shown. Together they begin the outline of a central tongue 31 of blank 25 which facilitates formation of the sidewall 21 at the forward end 18 of tray 11.

As shown, wall portion 33 of central tongue 31 may be bent upwardly along bend line 32, thereby forming the upstanding portion of sidewall 21 at the forward end 18 of the tray 11. The forwardmost portion 34 of central tongue 31 has a pair of parallel adjacent bend lines 35 and 36, at each of which the forwardmost portion 34 of the central tongue 31 is bent inwardly over the forward wall 33 until its locking tab 37 is inserted into a lock-receiving opening 38 to complete the forwardmost portion of the upstanding sidewall 21.

At the front end of the bend line 27 there is a transverse bend line 40 from which a lateral tongue 41 extends forwardly to a transverse bend line 42. When properly folded, tongue 41 extends along line 29 and upwardly from base panel 17 to form a portion of sidewall 21. Extending forwardly from bend line 42 is a locking panel 43, the function of which will become apparent hereafter.

Similarly, at the opposite side of the blank 25, there is a corresponding lateral tongue 44 supported by transverse bend line 45 which, when folded properly, extends along line 30 and upwardly from base panel 17 to complete the upstanding sidewall 21. A similar locking panel 47, which corresponds to locking panel 43, is supported by tongue 44 at transverse bend line 46, and functions to lock the sidewall 21 in place in a manner described below.

To assemble the tray 11, the two sidewall portions 27*a* and 28*a* are bent upwardly along lines 27 and 28, respectively, taking the two lateral tongues 41 and 44 with them into upwardly extending orientation. The two tongues 41 and 44 are then swung inwardly toward each other along bend lines 40 and 45, until they meet lines 29 and 30, respectively, and thereby constitute part of the upstanding wall of the tray 11.

Thereafter, the locking panels 43 and 47 are swung inwardly along lines 42 and 46, respectively, until they meet and extend along bend line 32. The forward end wall 33 is then swung upwardly to an erect position along locking panels 43 and 47, and the forwardmost portion 34 of the central tongue 31 is thereafter swung downwardly and rearwardly over the upper edges of panels 43 and 47, until locking tab 37 is inserted into lock receiving opening 38, to complete the assembly of the tray 11. Thus, it can be seen that the tray 11 is a single-piece unit.

It will be readily seen that the interlocking panels 43 and 47 are sandwiched between wall portions 33 and 34, and held in locking position by the wall portion 34, with its locking tab 37 inserted within lock-receiving opening 38. At the same time, these interlocking parts 34, 37, 38, 43, and 47 cooperatively hold lateral tongues 41 and 44 in position so that they function as part of the upstanding sidewall 21 of the tray 11. Also, it will be seen that the entire rear end portion 26 is conveniently left open, thereby providing easy access to the interior of the tray.

In use, a food item 19, such as pizza, may be loaded onto the tray 11 by placing the rear end portion 26 of the tray's peripheral edge 20 under the edge of the food product, and scooping the product onto the base panel 17 thereof. With the preferred construction of tray 11, as shown in FIG. 2, this may be accomplished without the need for touching the food product with one's hands, thus eliminating uncleanly handling practices often required with the use of conventional food containers.

In the manner and position as shown in FIG. 2, the tray 11 may then be inserted, forward end 18 first, through opening 15 of the outer bag-like container 10 and into the interior cavity 14 thereof, where it rests on the lower panel 13 of the container. Positioning the tray 11 toward the forward end of the container 10, as shown in FIG. 1, allows the open end of container 10 to extend beyond the rear edge 26 of tray 11 so as to facilitate closure of the container.

To complete the closure of container 10, the open end thereof is simply folded in any desired manner to secure the open end of the container shut. By way of example, the open end may be folded over and under that portion of container 10 upon which tray 11 rests, thereby maintaining the container in a closed position. Optionally, it is contemplated that an adhesive or other securing means (not shown) may be used to hold shut the openable end of container 10.

Figure 4:
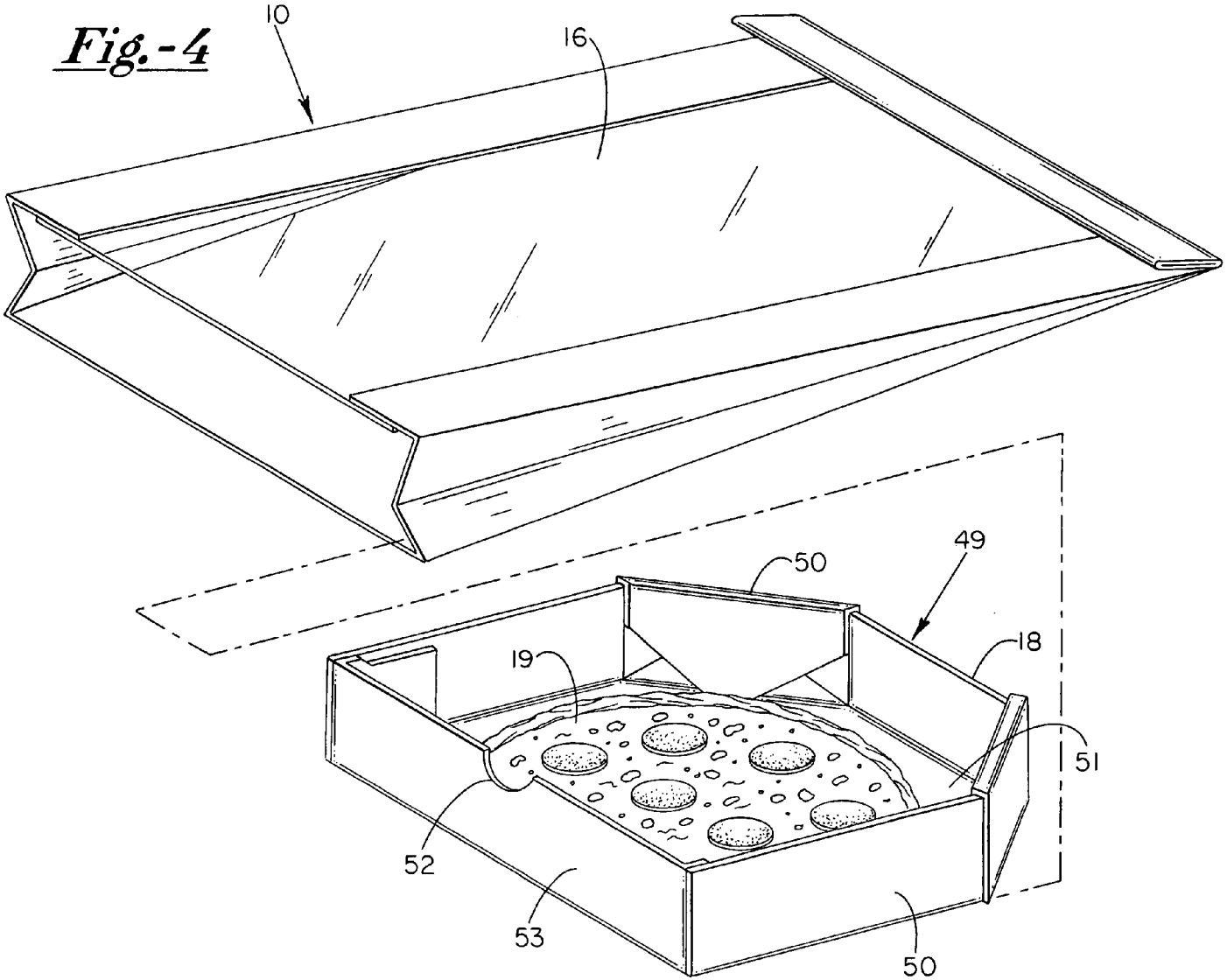
FIG. 4 is an exploded view similar to FIG. 2, showing the construction of an alternative food tray utilized in a second embodiment of the invention.

FIG. 4 shows an alternative tray 49 of a second embodiment of the invention which is comprised of a similar paperboard material and constructed in the similar manner, with the exception that the upstanding wall 50 extends entirely around the base panel 51, and the side access 52 is provided in a central and upper part of the rear wall portion 53 of wall 50. The extension of the upstanding wall across the rear end of the tray 49, therefore, can be readily accomplished by the average man skilled in the art. A substitute for the ready access provided in the preferred embodiment is provided in the form of the generally U-shaped opening 52, by means of which the user can readily engage the tray 49 and can remove same from the interior of the container 10 with ease.

It will be noted that in each of the two (2) embodiments of the invention, the tray is formed of a one-piece construction having interconnecting foldable sections designed to facilitate formation of the peripheral sidewall, and that the tray is intended to rest upon the lower panel of the outer bag-like container, is free to be moved laterally therewithin, and is provided with an readily accessible side access for facilitating loading, removal, and handling of food relative thereto.

Notably, the preferred embodiment of my invention has the added advantage of its marked accessibility, through its unrestricted side access, to the interior of the tray and food carried thereby. As a result of such free access, the operator or user of the tray may scoop the food to be carried thereon, such as pizza, without manually touching the food. This significantly enhances the cleanliness of the operation, which is imperative in the food handling business.

A further advantage of the present invention is the enhanced visibility of the food carried on the tray, because of the full fog-free window on the face of the container 10. Thus, a prospective buyer or owner of the container, or any other member of the public, can observe the desirability and/or variety of the food contained therein without removing same from the container. Also, by utilizing the fog-free window and paper combination of the container as described herein, the rate of respiration of the package is lower than conventional food cartons, which helps to preserve heat and extend the shelf life of the food product beyond that of conventional packaging available today.

In addition to the above, the rigid structure of the upstanding sidewall enables a plurality of the containers to be stacked one atop another, and the height of the upstanding sidewall extending over the food being carried prevents the upper panel of the containers from contacting the food. This protects and further helps to extend the shelf life of the food being carried on the tray.

It will, of course, be understood that various changes may be made in the form, details, arrangement and proportions of the parts without departing from the scope of the invention which comprises the matter shown and described herein and set forth in the appended claims.

The invention claimed is:

1. A carry-out food container, comprising:

(a) a flexible bag-like container having an upper panel and a lower panel connected together to form an interior cavity with an opening thereto;

(b) a food tray constructed to be carried within said interior cavity of said flexible container, said tray having a generally planar base panel with a peripheral edge extending therearound;

(c) an upstanding sidewall supported by said base panel and extending at least partially around said peripheral edge so as to define an interior tray area adapted for receipt of an article of food, said sidewall having a side access to said interior area of said tray along a portion of said peripheral edge;

(d) said tray being freely movable relative to said flexible container to facilitate free insertion and removal thereof from within said interior cavity of said flexible container through said opening thereto;

(e) said tray being suitably constructed for storage within said interior cavity of said flexible container in such position that said side access to said interior of said tray is adjacent to and faces the opening in said flexible bag-like container;

(f) at least a portion of said upper panel of said flexible container being transparent;

(g) at least one section of said sidewall of said tray opposite said side access of said tray formed of two or more layers, the portion of said sidewall with the multi-layer section forming a reinforced gripping area;

a base panel of said tray having predetermined dimensions defined by a forward edge, two side crease lines, a rear crease line and two diagonal edges extending from the ends of said side creases lines to the ends of said rear crease line, and an aperture along the rear crease line, a sidewall section adjacent each of said side crease lines, opposite said base panel, each comprising a predetermined height and length, said length extending beyond each of the intersections of said side crease lines and said diagonal edges, said sidewall section including a first sidewall crease lines oriented at the intersection of said side crease line and said diagonal edge, perpendicular to said side crease line, and a second sidewall crease line parallel said first sidewall crease oriented a predetermined distance from said first sidewall crease line, a diagonal section defined by the area between said first and second sidewall crease line having a predetermined length corresponding to the length of said diagonal edge, a sidewall tab section defined by the area extending beyond the second sidewall crease line having a predetermined height less than that of the sidewall section, a rear sidewall section adjacent said rear crease line, opposite said base panel, comprising a predetermined height and length, said rear sidewall section comprising a first rear sidewall section, a second rear sidewall section, and a third rear sidewall section, said first rear sidewall section having a predetermined height corresponding to the sidewall sections, said first and second rear sidewall sections separated by a first rear sidewall crease line, said first rear sidewall crease line oriented parallel to said rear score line, the second rear sidewall section having a predetermined width corresponding to the thickness of the blank, said second rear sidewall section and said third rear sidewall section separated by a second rear sidewall crease line, said second rear sidewall crease line oriented parallel to said first rear sidewall crease line, said third rear sidewall section having a predetermined height corresponding to the height of the first rear sidewall section, said third rear sidewall section including an interlocking tab having predetermined dimensions corresponding to said aperture.

2. The carry-out container defined in claim 1, wherein the crease lines are scorelines.

* * * * *